US005096169A

United States Patent [19]

Behnke

[11] Patent Number: 5,096,169

[45] Date of Patent: Mar. 17, 1992

[54] SETTING TOOL

[76] Inventor: Richard R. Behnke, 663 Kingswood Ave., Fond du Lac, Wis. 54935

[21] Appl. No.: 255,586

[22] Filed: Oct. 11, 1988

[51] Int. Cl.[5] ..... B25B 1/00

[52] U.S. Cl. ..... 269/3

[58] Field of Search ..... 269/3, 196, 6, 229

[56] References Cited

U.S. PATENT DOCUMENTS

| | | | |
|---|---|---|---|
| 2,779,089 | 1/1957 | Allen | 269/3 |
| 2,938,414 | 5/1960 | Blomme . | |
| 2,983,036 | 5/1961 | Guard | 269/3 |
| 4,327,608 | 5/1982 | Keys | 269/3 |

FOREIGN PATENT DOCUMENTS

| | | | |
|---|---|---|---|
| 381268 | 10/1932 | United Kingdom | 269/3 |

*Primary Examiner*—J. J. Hartman

*Attorney, Agent, or Firm*—Donald Cayen

[57] ABSTRACT

A setting tool conveniently grips a jewelry finding while providing a person working on the finding with maximum accessibility to it. The setting tool comprises a handle and a lockable cam for moving a pair of clamps radially of the handle axis between opened and closed positions. A variety of interchangeable clamp jaws are provided. The jaws are designed to accommodate a wide range of finding sizes and shapes. In one embodiment, the jaws cooperate with a moveable anvil to hold a pierced type earring. In another embodiment, the jaws have respective tracks that cooperate to hold findings such as pendant wire settings.

10 Claims, 4 Drawing-Sheets

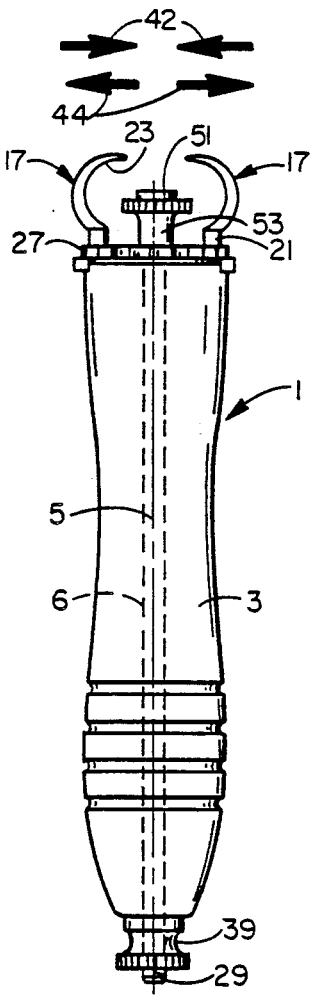
FIG 1
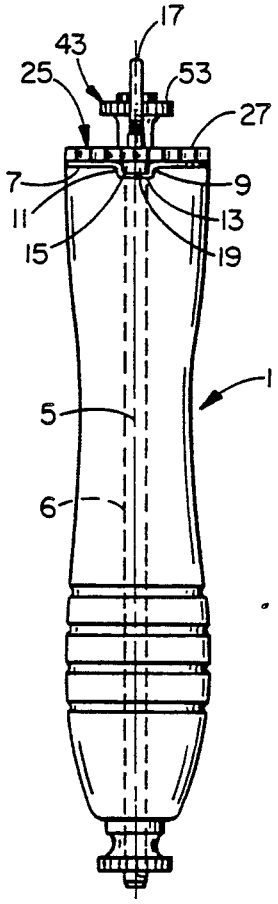
FIG 2
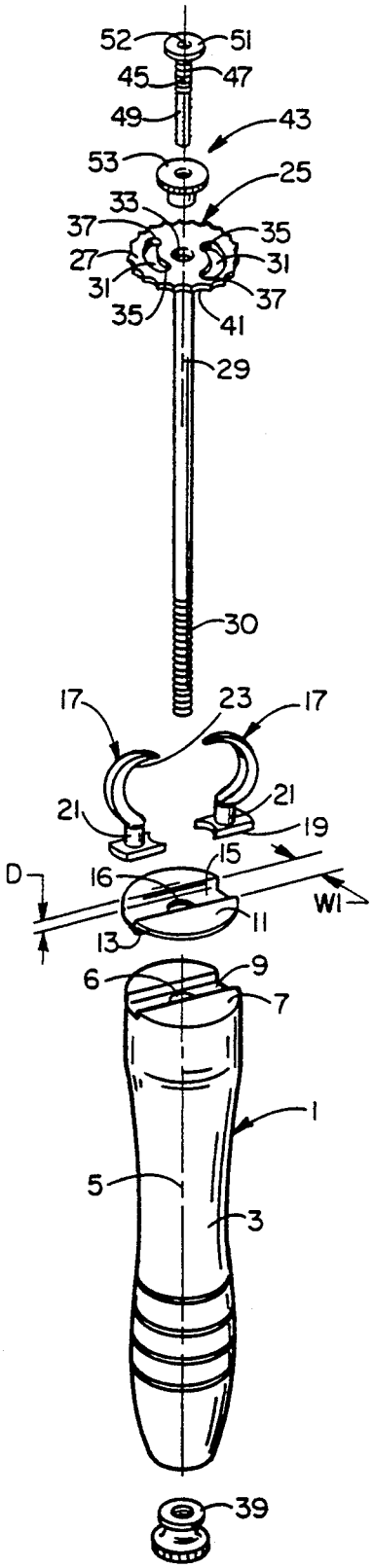
FIG 3
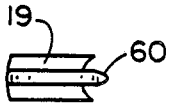
FIG 6
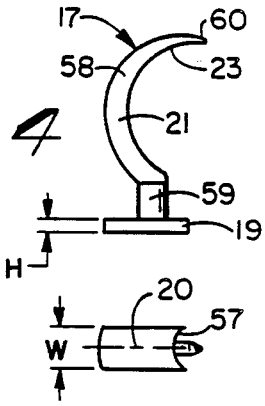
FIG 4
FIG 5
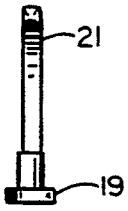
FIG 7

SETTING TOOL

BACKGROUND OF THE INVENTION

1. Field of the Invention

This invention pertains to work holders, and more particularly to apparatus for releaseably gripping small workpieces.

2. Description of the Prior Art

It has long been a problem to satisfactorily hold small jewelry findings such as earrings and wire settings while repairing or otherwise working on them. The findings must be firmly held in place, but the holder must not interfere with other tools or the jeweler's fingers as he performs the necessary operations.

Prior solutions to the problems associated with gripping jewelry findings have not been entirely satisfactory. A holding device commercially available under the trademark Borel has jaws that are operated by a rotatable cam plate. However, that device is limited to holding watches and other relatively large items, and it is not suitable for gripping small earrings or other wire settings.

Another work holder known as a Rio Grande setting vice includes a base with a pair of upstanding posts. A pierced type earring is guided on a movable anvil located between the posts. Spring loaded pins projecting from the posts press the earring onto the anvil. The setting vice suffers the disadvantage of not being able to hold other types of wire settings. Another drawback is that the posts block access to a large portion of the periphery of the earring, thereby making the setting device awkward to use.

Other prior work holders include a relatively large vice-like tool sold under the "VIGOR" trademark. The jaws of the VIGOR tool are mounted to a hand-held handle, and they are capable of gripping pierced type earrings. However, the jaws cannot be used to hold other types of jewelry findings. Another difficulty is that the entire tool is boxy and cumbersome, and the jaws prevent access to the workpiece from several different directions.

A workpiece holder manufactured by Castille Industries and marketed under the E-Z SET trademark has a pair of pointed jaws swingably mounted to a handle. A nut threaded onto the handle forces the jaws closed. A rod threaded in the handle has a small hole for receiving a pierced earring shaft. The E-Z SET tool cannot hold other types of jewelry pieces.

A relatively old design jewelry holder employs a rotatable handle to force a tapered surface thereon against corresponding surfaces of spring loaded pivotable jaws. The closed jaws hold the jewelry finding against a movable anvil. That particular design is quite expensive. Further, like other work holders presently available, that holder is very limited in the types of jewelry findings it can grip.

Thus, a need exists for a tool capable of gripping several types of small workpieces while providing adequate access to the workpiece.

SUMMARY OF THE INVENTION

In accordance with the present invention, a versatile setting tool is provided that securely but gently holds several kinds and sizes of workpieces without hindering access to them. This is accomplished by apparatus that includes interchangeable clamps that grip the workpieces at locations remote from a clamp holding plate.

The clamps have respective bases that are slideable within a diameter groove in one end of an elongated and comfortable hand-held handle. Two clamps are used with a handle, with the clamps being diametrally opposed about the handle axis. Upstanding from the base of each clamp is a shaft, and the shaft terminates in a work holding jaw. The clamp shafts protrude through slots in a cam plate placed over the clamp bases. A long rod has one end thereof attached to the cam plate. The rod second end extends out the handle distal end. A locking device on the rod second end selectively locks and unlocks the cam plate and clamps to the handle. The cam plate slots are spiral in shape about the handle axis, with the clamps placed on opposite sides of the handle axis, rotating the cam plate on the handle forces the clamps to slide in the groove toward or away from the handle axis.

The clamps are designed with various combinations of workpiece gripping jaws that match a wide range of jewelry finding sizes and shapes. The jaws include tracks with various cross sections and radii of curvature. Jaws for holding wire settings can have more than one track for gripping different sized and shaped findings. In one design, the jaws are generally crescent shaped, with the work gripping ends being formed as sharp points. In all designs, the jaws grip the workpiece at a relatively great distance from the cam plate. Consequently, the wire setting or other jewelry finding is accessible through a wider range of three dimensional directions than was possible with prior tool holders.

Further in accordance with the present invention, an anvil is selectively insertable into the cam plate and threaded rod coaxial with the handle axis. The anvil is movable axially relative to the handle and the clamps. The anvil is especially useful for cooperating with the gripping points of the crescent shaped jaws to hold pierced earring settings.

Other advantages, benefits, and features of the present invention will become apparent to those skilled in the art upon reading the detailed description of the invention.

BRIEF DESCRIPTION OF THE DRAWINGS

FIG. 1 is a front view of the setting tool of the present invention with a certain pair of workpiece holding clamps therein.

FIG. 2 is a side view of the setting tool of FIG. 1.

FIG. 3 is an exploded perspective view of the setting tool of the present invention.

FIG. 4 is a side view of a clamp typically used with the setting tool of the present invention.

FIG. 5 is a bottom view of the clamp of FIG. 4.

FIG. 6 is a top view of the clamp of FIG. 4.

FIG. 7 is an end view of the clamp of FIG. 4.

DETAILED DESCRIPTION OF THE INVENTION

Figure 8:
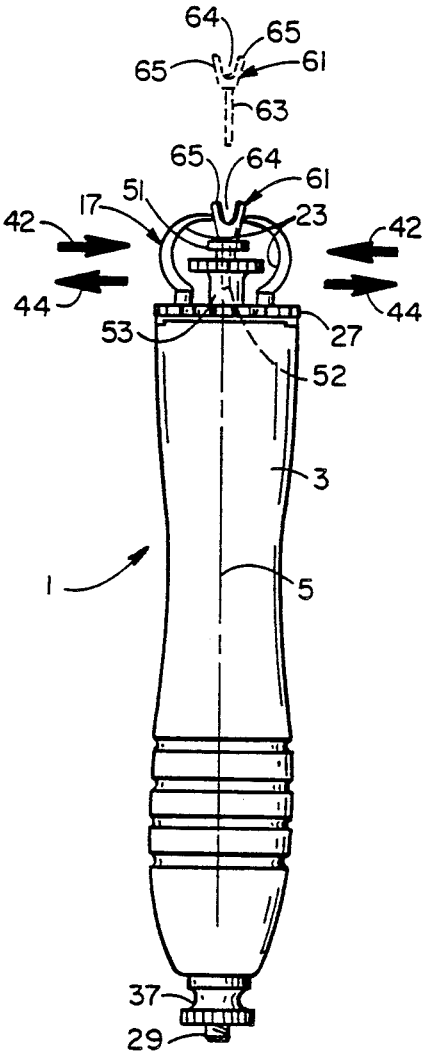
FIG. 8 is a side view of the setting tool of the present invention in use to hold a pierced type earring.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–3, a setting tool 1 is illustrated that includes the present invention. The setting tool is particularly useful for holding small jewelry findings for repairing and otherwise working on them. However, it will be understood that the invention is not limited to jewelry related applications.

The setting tool 1 comprises a base 3, which may be in the form of an elongated and comfortable handle having a longitudinal axis 5. The base or handle 3 has a hole 6 extending longitudinally therethrough. The handle may be made of wood. One face 7 of the handle is formed with a groove 9 that passes perpendicular to and through the axis 5. A thin clamp track 11 has an exterior protruding ridge 13 that interfits within the handle groove 9. The clamp track 11 further has an interior groove 15 that corresponds with the ridge 13. The clamp track has a hole 16 therethrough that is concentric with the handle hole 6 when the clamp track is centered on the handle face 7.

Slideably received in the clamp track groove 15 is a pair of substantially identical clamps 17. Each clamp 17 comprises a base 19 adapted to slide within the clamp track groove 15, a shaft 21 connected to and upstanding from the base 19, and a workpiece gripping jaw 23 at the free end of the shaft 21. The clamps will be described in greater detail hereinafter.

To slideably secure the clamps 17 within the clamp track groove 15, a locking cam 25 is employed. In the illustrated construction, the cam 25 is fabricated as a thin cam plate 27 soldered or otherwise fixed to one end of a long rod 29. The second end 30 of the rod 29 is threaded. The cam plate 27 is fabricated with a pair of slots 31. The slots 31 are symmetrical about a hole 33 through the center of the cam plate. The hole 33 extends into the rod 29. The slots are generally spiral shaped, with the slot ends 35 being closer to the central hole 33 than the slot ends 37. The slots have respective widths that permit the shafts 21 of the clamps 17 to pass therethrough, but the clamp bases 19 cannot pass through the slots. Accordingly, when the clamp bases are within the clamp track groove 15 and the cam plate 27 is over the clamp shafts with the cam rod 29 inserted through the handle hole 6, the clamps are captured between the clamp track and the cam plate. A nut 39 is threaded onto the handle end 30. With the nut 39 loosened, the cam plate can be rotated by scallops 41 on the outer periphery of the cam plate. Rotating the cam plate forces, by means of the spiral slots 31, the clamps either toward or away from each other and the handle axis 5, as indicated by arrows 42 and 44, respectively. As a result, the distance between the clamp jaws 23 may be positioned 5 at any desired location within the design range of the setting tool. After positioning the clamps, the nut 39 is tightened to firmly draw the cam plate against the clamp bases. In turn, the clamp bases squeeze the clamp track ridge 13 against the handle groove 9 and thereby lock the cam plate and clamps in place.

To assist holding selected jewelry items within the clamps 17, the present invention includes a movable anvil 43. The anvil 43 has a post 45 with an elongated threaded portion 47. The post threaded portion 47 is fabricated with one or more flats 49. Preferably, the threaded portion 47 has a square cross section, with threads being formed only at the threaded portion corners. The second end of the post 45 has a head 51. A small hole 52 extends axially through the head 51 and the threaded portion 47. A knurled nut 53 mates with the post threaded portion 47. The post threaded portion normally protrudes beyond the nut 53 and is received in the hole 33 in the cam plate 27 and rod 29. The cam plate and rod hole 33 is formed with flats that correspond to the flats 49 of the post. Consequently, the post cannot rotate inside the cam plate and rod, and turning the nut 53 causes the head 51 to move axially relative to the cam plate.

Now looking especially at FIGS. 4–7, the clamps 17 will be described in detail. Each clamp base 19 has a longitudinal centerline 20, a height H that is slightly greater than the depth D of the clamp track groove 15 (FIG. 3), and a width W that is slightly less than the width Wl of the clamp track groove. The base has an inner end surface that may be flat and perpendicular to the base longitudinal centerline 20. However, in the preferred embodiment, the base inner surface is semi-cylindrical in shape, as designated at reference numeral 57. The radius of the semi-cylindrical surface 57 is equal to the radius of the rod 29. Preferably, the base width W is equal to the diameter of the rod. A rod diameter of approximately 0.187 inches works very well.

Upstanding from the base is the shaft 21, which includes a relatively short pedestal 59. The pedestal 59 is 5 preferably cylindrical in shape, having a diameter slightly less than the width of the slots 31 in the cam plate 27. Joined to the pedestal 59 is a beam 58, which preferably has a generally square cross section and generally crescent longitudinal shape. The beam 58 terminates in the workpiece gripping surface 23. Preferably, the gripping surface is a rather sharp point 60.

The setting tool 1 and clamps 17 of the present invention are advantageously used together to grip pierced type earring settings. Turning to FIG. 8, a typical pierced type earring 61 is shown in conjunction with the setting tool. To grip the pierced earring 61 in the setting tool, the nut 37 is loosened on the rod 29. The cam plate 27 is rotated to spread the clamps 17 apart, i.e., away from the central axis 5 in the direction of the arrows 44. The shaft 63 of the pierced earring 61 is inserted into the anvil hole 52 until the pierced earring rests on the post head 51. The cam plate is then rotated in the opposite direction to slide the clamps toward each other, i.e., in the direction of arrows 42, until the gripping ends 23 enter the spacings 64 between the pierced earring prongs 65. The anvil nut 53 is turned to raise the head 51. The cam plate and anvil nut are adjusted together until the pierced earring is firmly but gently gripped between the jaw surfaces 23 and the anvil head. Then the locking nut 37 is tightened, and the pierced earring is securely held in place for setting a stone or performing other work on it. With the pierced earring 61 in place, it is accessible through a large range of three dimensional directions.

To remove the pierced earring 61 from the setting tool 1, the nut 53 is rotated to lower the anvil head 51 and the pierced earring from against the jaw gripping surfaces 23. The nut 37 is loosened, and the cam plate 27 is rotated to separate the clamps 17 in the direction of arrows 44. The pierced earring is then removed from the head hole 52.

Further in accordance with the present invention, clamps capable of holding jewelry items other than pierced type earring settings 61 form components of the setting tool 1. Looking at FIGS. 9–12, a series of clamps 67, 69, 71, and 73 are depicted that are suitable for gripping jewelry findings of numerous sizes and shapes.

Figure 9A:
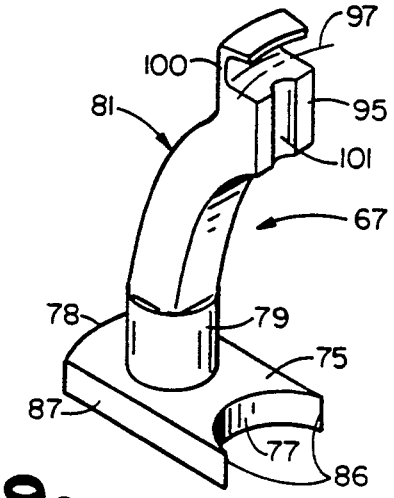
FIG. 9*a* is an enlarged perspective view of a workpiece holding clamp according to the present invention.
Figure 9C:
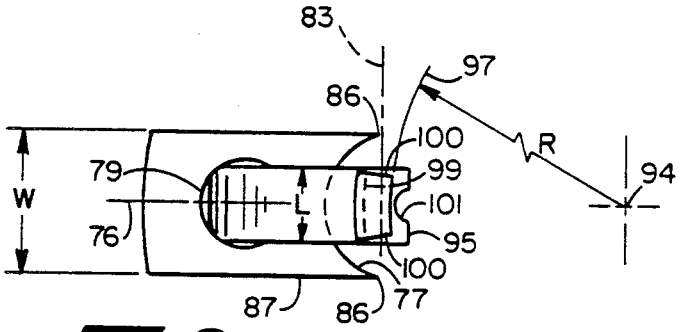
FIGS. 9*b* and 9*c* are side and top views, respectively, of the clamp of FIG. 9*a*.
Figure 9B:
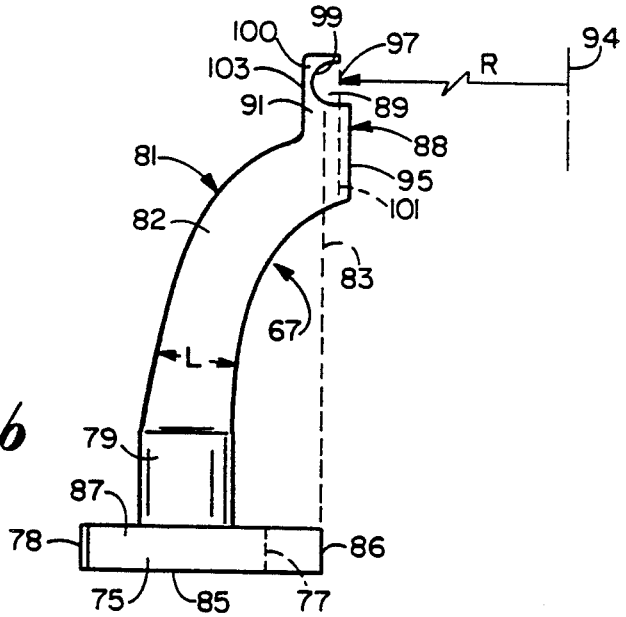

With particular reference to FIGS. 9a–9c, the clamp 67 has a base 75 with a longitudinal centerline 76 and a concave inner end surface 77 that are substantially identical to the base 19 and end surface 57 described previously with respect to clamp 17, FIGS. 4–7. The base outer end 78 of the clamp 67 may have a radius approximately equal to the radius of the cam plate 27 (FIG. 3). The clamp 67 further has a shaft 81 comprised of a short cylindrical pedestal 79 upstanding from the base 75. The shaft upper end is in the form of a beam 82 integrally joined to the pedestal 79. The beam 82 preferably has a generally square cross section, with each side having a length L.

Phantom line 83 represents a reference plane that is perpendicular to the base undersurface 85 and that passes through the longitudinal axis of the semi-cylindrical surface 77 perpendicular to the base centerline 76. In the illustrated construction, the width W of the base is the same dimension as the diameter of the surface 77. Therefore, the intersections 88 of the base side walls 87 and the inner surface 77 lie on the reference plane 83. The diameter of the surface 77 equals the diameter of the rod 29, so the reference plane 83 also represents a plane through the center of the rod, and thus through the setting tool handle axis 5, if the clamp 67 were to be placed in the setting tool 1 with the surface 77 against the rod. The shaft beam 82 bends in a smooth curve from the pedestal 79 toward the reference plane 83.

At the free end of the shaft 81 is a jaw 88. The jaw 88 includes a short upright section 91 having a forward face 95. The forward face 95 is located on the opposite side of the reference plane 83 as the base inner surface 77. A track 89 is formed at the upper end of the forward face 95. The track 89 is defined by a three dimensional curved surface 99. Preferably, 5 the surface 99 has a cross section in the form of a semi-ellipse. The center of the ellipse follows a curved central axis 97 that is parallel to the clamp base undersurface 85. The ellipse major diameter is horizontal in FIGS. 9a–9c. The curved central axis 97 is located at a distance R from an axis 94 that is perpendicular to the base undersurface 85. Curved central axis 97 lies between the reference plane 83 and the axis 94.

The length of the track 89 is the same as the length L of the square beam 82 of the clamp shaft 81. The back surface 103 of the upright section 91 may be parallel to the curved central axis 97. To aid in clamping a wide variety of sizes and shape findings, the opposite sides 100 of the upright section 91 adjacent the track 89 are tapered so as to converge toward the axis 94. Formed in the forward face 95 is a groove 101.

With a pair of clamps 67 installed on the setting tool 1 of the present invention, a variety of very small findings, not shown, can be gripped in the tracks 89 and worked on with ease. The grooves 101 provide clearance for the posts of the smallest pierced type earrings when their prongs are gripped in the tracks 89 and the forward faces 95 brought together. I have found that a track with a semi-elliptical surface 99 having a major radius of approximately 0.031 inches and a minor radius of approximately 0.019 inches works very well. A preferred size for the groove 101 is approximately 0.040 inches in diameter. A satisfactory dimension for the length L between the beam sides is 0.098 inches. A taper of approximately 0.005 inches for each side 100 adjacent the track is satisfactory. With dimensions approximately as mentioned, the finest commonly encountered jewelry findings can be gripped and worked on while providing maximum accessibility to them.

Figure 10A:
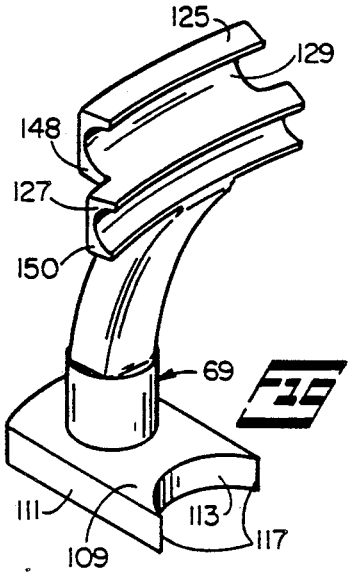
FIG. 10*a* is an enlarged perspective view of a modified clamp according to the present invention.
Figure 10C:
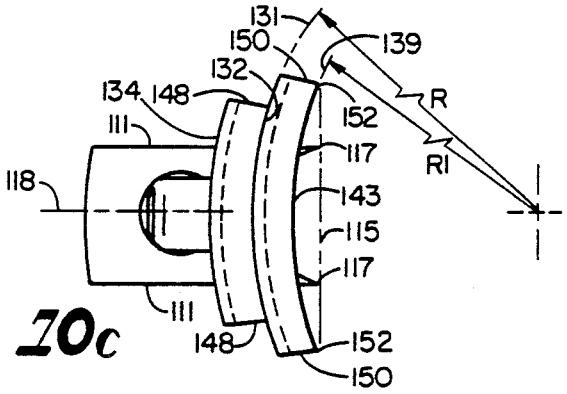
FIGS. 10*b* and 10*c* are side and top views, respectively, of the clamp of FIG. 10*a*.
Figure 10B:
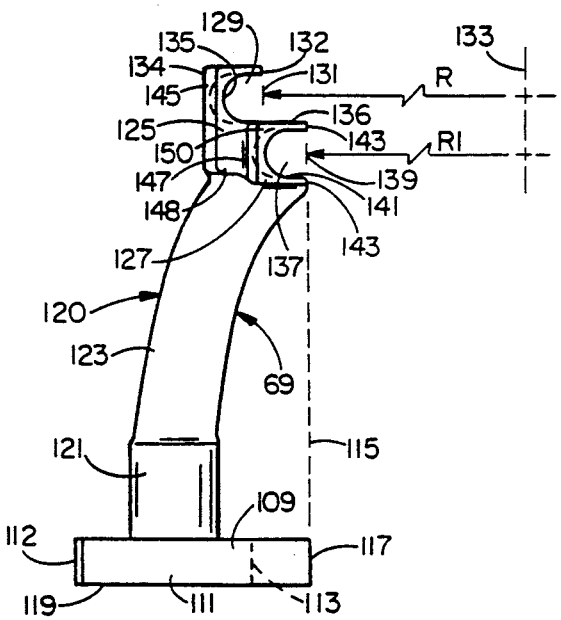

Now turning to FIGS. 10a–10c, the clamp 69 has a base 109 with side walls 111, a back surface 112, and a semicylindrical inner end surface 113. Reference plane 115 passes through the longitudinal axis of the inner surface 113 and also through the intersections 117 of the base side walls 111 and the inner end surface. The reference plane 115 is perpendicular to the base undersurface 119 and to the base longitudinal centerline 118. Clamp 69 further has a shaft 120 comprised of a round pedestal 121 and a square beam 123 integrally upstanding from the pedestal. The shaft beam 123 curves forwardly from the pedestal end thereof toward the reference plane 115.

To the free end of the beam 123 are attached two wings 125 and 127. Rearward wing 125 is formed with an upper track 129 that extends along a curved central axis 131. Curved central axis 131 is parallel to the base undersurface 119, and it is located at a radius R from an axis 133. Axis 133 is perpendicular to the base undersurface 119. The surface 135 of the track 129 is preferably semielliptical in cross section, with the ellipse center coinciding with the curved central axis 131. The forward face 132 and the back surface 134 of the rearward wing 125 are preferably parallel to each other and to the curved central axis 131. The track surface 135 blends smoothly and tangentially into the top surface 136 of the forward wing 127.

Wing 127 is formed with a lower track 137 having a curved central axis 139 parallel to the base undersurface 119 and at a radius Rl from the axis 133. Lower track surface 141 is semi-elliptical in cross section and concentric with the curved central axis 139. The difference in dimensions of the radii R and Rl define the backset of the track 129 relative to the track 137 and of the rearward wing forward face 132 relative to the forward faces 143 of the wing 127. The dimensions R and Rl are very carefully controlled, because the backset of the forward face 132 from the forward faces 143 is very important for the proper operation of the clamp 69. The forward faces 143 and the back surface 147 of the forward wing are preferably parallel with the curved central axis 139. The forward faces 143 do not extend forwardly, i.e., toward the axis 133, of the reference plane 115. Rather, the forward wing forward faces 143 terminate at their intersection points 152 with the reference plane 115. As best shown in FIG. 10c, the end surface 148 and 150 of the rearward and forward wings, respectively, converge toward the axis 133.

The dimensions of the clamp 69 are chosen to suit portions of wire settings and other findings that are slightly larger than can be properly gripped by the clamp 67 of FIGS. 9a–9c. Preferably, the semi-elliptical track surfaces 135 and 141 have major radii of approximately 0.031 inches and minor radii of approximately 0.029 inches. A preferred backset between the curved central axes 131 and 139 is approximately 0.065 inches.

Figure 11C:
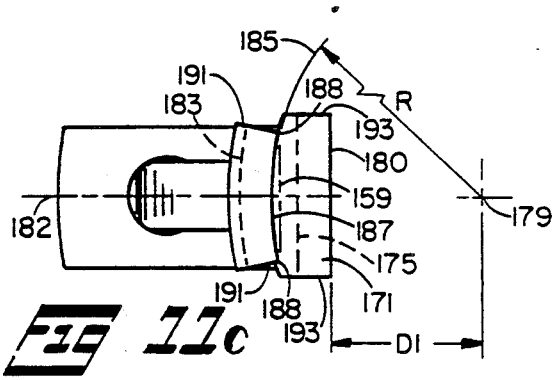
FIGS. 11*b* and 11*c* are top and side views, respectively, of the clamp of FIG. 11*a*.
Figure 11B:
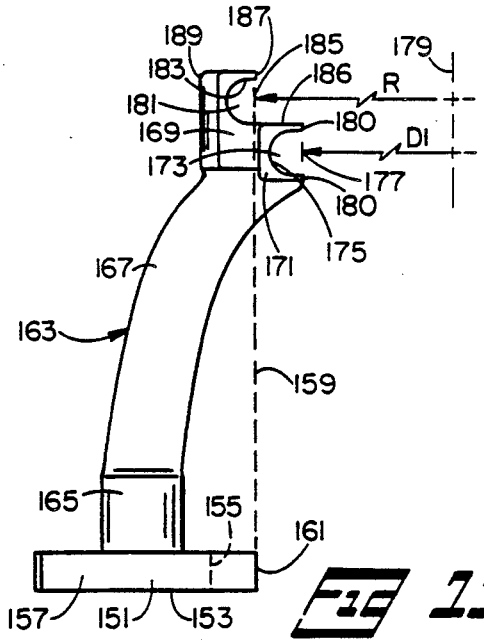
Figure 11A:
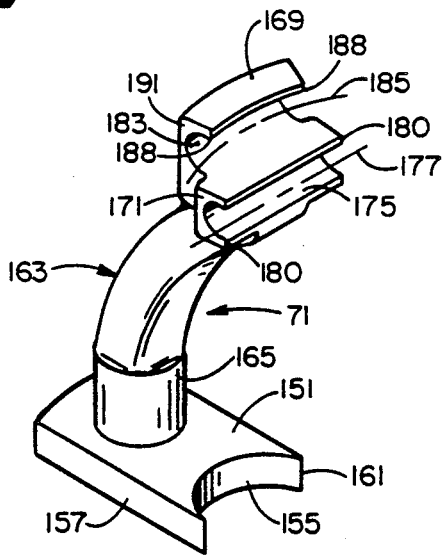
FIG. 11*a* is an enlarged perspective view of a further modified clamp according to the present invention.

Next looking at FIGS. 11a–11c, the clamp 71 comprises a base 151 having an undersurface 153, a semi-cylindrical inner end surface 155, and side walls 157. Reference plane 159 extends through the longitudinal axis of the end surface 155 and through the intersections 161 of the end surface 155 with the side walls 157. The reference plane 159 is perpendicular to the base undersurface 153 and to the base longitudinal centerline 182. Upstanding from the base 151 is a shaft 163 that is preferably manufactured with a short cylindrical pedestal 165 and a curved upper beam 167. At the free end of the shaft 163 are a pair of wings, an upper wing 169 and a lower wing 171. Lower wing 171 may be slightly longer than upper wing 169. A straight track 173 is formed in the lower wing 171. The track 173 has a surface 175 that is semi-elliptical in cross section, with the ellipse center being coincident with a straight central axis 177. The central axis 177 is parallel to the reference plane 159 and to the base undersurface 153. The central axis 177 is located at a distance Dl from an axis 179 that is perpendicular to the base undersurface 153. The lower wing has planar forward faces 180, which are straight and parallel to the central axis 177.

A track 181 is fabricated in the upper wing 169. The track 181 has a semi-elliptical cross sectional surface 183 with the ellipse center being coincident with a curved central axis 185. The track surface 183 blends smoothly and tangentially into the top surface 186 of the lower wing 171. The curved central axis 185 is at a radius R from the axis 179. Upper wing forward face 187 and back surface 189 are parallel to the curved central axis 185. As best shown in FIGS. 11a and 11c, the end surfaces 191 of the upper wing converge toward the axis 179, whereas the ends 193 of the lower wing are perpendicular to the clamp longitudinal centerline 182. The reference plane 159 intersects the upper wing forward face 187 at its intersections 188 with the wing end surfaces 191. It is also acceptable if the intersections 188 are located slightly forward, i.e., toward the axis 179, of the reference plane 159.

The dimensions of the clamps 71 are such that the tracks 173 and 181 are capable of gripping findings that are slightly beyond the range of the sizes and shapes that can be efficiently gripped by the clamps 69. Examples of useful dimensions for the clamp 71 include a minor radius of approximately 0.022 inches for the semi-elliptical track surfaces 175 and 183, and corresponding major radii of approximately 0.031 inches.

Figure 12A:
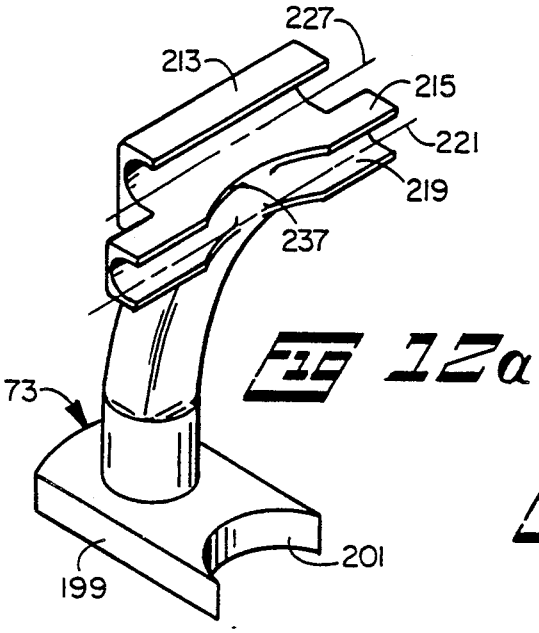
FIG. 12*a* is an enlarged perspective view of another modified clamp according to the present invention.
Figure 12C:
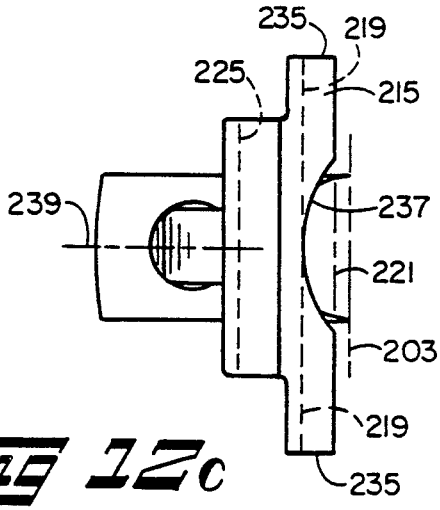
FIGS. 12*b* and 12*c* are top and side views, respectively, of the clamp of FIG. 12*a*.
Figure 12B:
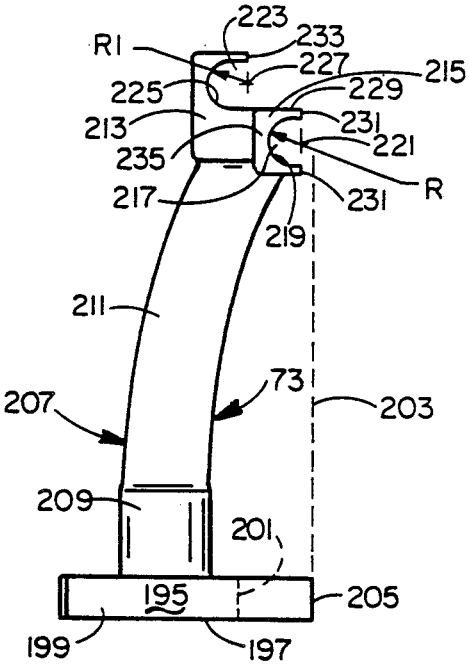

Now turning to FIGS. 12a–12c, the clamp 73 comprises a base 195 with an undersurface 197, side walls 199, and semicylindrical inner end surface 201. Reference plane 203 passes through the longitudinal axis of the inner surface 201 and through the intersections 205 of the side walls 199 and the semi-cylindrical inner surface 201. A shaft 207 connected to and upstanding from the base 195 includes a short cylindrical pedestal 209 and a curved beam 211. At the free end of the shaft 207 are a pair of wings 213 and 215. The forward wing 215 is longer than and is joined to the front lower portion of the back wing 213. Front wing 215 defines a track 217 having a surface 219 that is semi-elliptical in cross section with the ellipse centered on a straight central axis 221. Back wing 213 defines a track 223 having a semi-elliptical surface 225 in cross section that is centered on a straight central axis 227. Both axes 221 and 227 are parallel to the base undersurface 197 and lie in back of the reference plane 203, that is, to the left of the reference plane in FIGS. 12b and 12c. The track surface 225 blends 5 smoothly into the top surface 229 of the lower wing 215. The lower wing 215 is bounded by forward faces 231 that are coplanar with the straight central axis 221. Similarly, the back wing 213 has a forward face 233 that is coplanar with the straight central axis 227.

The clamp 73 is designed to hold straight sided wire settings and other findings of relatively large sizes. The backset of the upper wing forward face 233 from the forward wing front faces 231 is very important; a preferred backset is approximately 0.060 inches. Other dimensions include a forward wing length of approximately 0.498 inches between the opposed ends 235. To allow the relatively long forward wing to fit through the cam plate slots 31 (FIG. 3), a segment bound by arcuate surface 237 is cut out of the forward wing, preferably symmetrical about the clamp center line 239. The depth of the surface 237 is such that it may be tangent to the track surface 219 in the vicinity of the clamp center line 239. The clamp 73 is capable of gripping the largest sized findings that are in common use.

Figure 13:
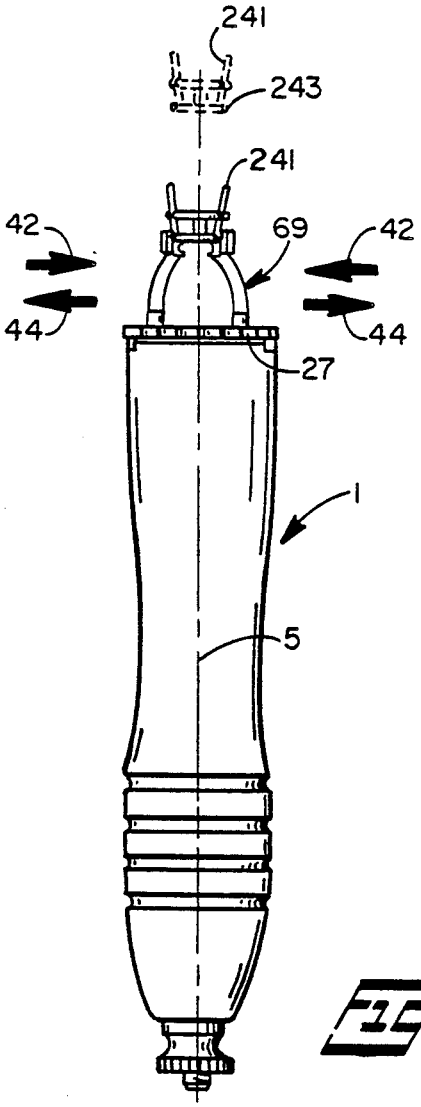
FIG. 13 is a front view of the present invention shown holding a pendant type wire setting.

FIG. 13 shows an example of the setting tool 1 in use with a pair of clamps 69 to hold a pendant wire setting 241. The cam plate 27 is rotated about the handle axis 5 to open the clamp jaws in the direction of arrows 44 until the selected pendant wire setting 241 can fit between the proper tracks 129 or 137. In the example of FIG. 13, the lower gallery 243 of the pendant 241 best fits in the upper tracks 129 of the clamps 69. Rotating the cam plate to move the clamps in the directions of arrows 42 causes the clamp jaws to grip the gallery 243. When held by the setting tool of the present invention, the pendant wire setting is accessible through a large range of three dimensional directions.

Thus, it is apparent that there has been provided, in accordance with the invention, a setting tool and clamps that fully satisfy the aims and advantages set forth above. The setting tool 1, when used in conjunction with the clamps 17, 67, 69, 71, and 73, is capable of gripping practically all sizes and shapes of jewelry findings that are encountered by jewelers and jewelry repair personnel. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A setting tool for gripping selected workpieces comprising:

a. an elongated handle having first and second ends and a longitudinal axis and a hole therethrough generally coaxial with the longitudinal axis, the handle first end defining a diametral groove;

b. a pair of clamps comprising respective bases having longitudinal axes and planar undersurfaces slideably received within the handle groove and respective shafts upstandingly attached to the bases;

c. cam means for holding the clamps within the handle grooves and for radially sliding the clamps to closed and open positions toward and away from each other, respectively, the cam means comprising:

i. a cam plate located adjacent the handle first end and defining a pair of spiral slots, the cam plate retaining the clamps in the handle groove with the clamp shafts passing through respective cam plate slots; and ii. a threaded rod attached to the cam plate and extending through the handle hole; and d. locking means for cooperating with the threaded rod to selectively permit the cam plate to be rotated to radially slide the clamps within the handle first end and to lock the cam plate to the handle and thereby prevent radial sliding of the clamps.

2. The setting tool of claim 1 further comprising a clamp track interposed between the handle first end and the cam plate, the clamp track having a ridge that interfits within the handle groove and an interior groove that slidingly receives the clamp bases.

3. The setting tool of claim 1 wherein each clamp shaft has a free end and a jaw at the free end of the shaft, the jaw comprising first and second wings extending from the shaft and defining respective first and second tracks for gripping selected workpieces, the first and second tracks having respective central axes that are generally parallel to the clamp base undersurface.

4. The setting tool of claim 3 wherein the wings extend at unequal lengths from the shaft.

5. The setting tool of claim 3 wherein the central axis of at least one of the first and second tracks is curved.

6. The setting tool of claim 3 wherein at least one of the first and second tracks is defined by a surface that is semi-elliptical in cross section.

7. The setting tool of claim 6 wherein the track semi-elliptical surface has a major axis and a minor axis and is oriented with the major axis lying generally parallel to the clamp base undersurface and the minor axis generally perpendicular to the clamp base undersurface.

8. The setting tool of claim 3 wherein:

a. the base of each clamp comprises an inner end surface lying generally below the first and second wings and a back surface opposite the inner end surface;

b. the clamp inner end surface defines a reference plane that is perpendicular to the clamp base undersurface and to the base longitudinal axes; and c. at least a portion of the central axis of at least one of the first and second tracks lies between the reference plane and the base back surface.

9. The setting tool of claim 3 wherein:

a. the clamp base comprises a semi-cylindrical inner end surface lying generally below the first and second wings and a back surface opposite the concave end surface;

b. the clamp defines a reference plane passing through the axis of the base semi-cylindrical inner end surface, the reference plane being substantially perpendicular to the clamp base undersurface and to the base longitudinal axis; and c. at least a portion of the central axis of at least one of the first and second tracks lies between the reference plane and the base back surface.

10. The setting tool of claim 3 wherein at least one wing is formed with opposed end surfaces that converge in the direction of the reference plane.

* * * * *